United States Patent [19]

Hamm

[11] Patent Number: 4,841,108

[45] Date of Patent: Jun. 20, 1989

[54] RECLOSER PLENUM PUFFER INTERRUPTER

[75] Inventor: Sidney R. Hamm, Muskego, Wis.

[73] Assignee: Cooper Industries, Inc., Houston, Tex.

[21] Appl. No.: 117,604

[22] Filed: Nov. 6, 1987

[51] Int. Cl.[4] ..... H01H 33/88

[52] U.S. Cl. ..... 200/148 A; 200/148 G

[58] Field of Search ..... 200/148 A, 148 B, 148 G

[56] References Cited

U.S. PATENT DOCUMENTS

| | | | |
|---|---|---|---|
| 3,814,883 | 6/1974 | Milianowicz | 200/148 G |
| 4,663,504 | 5/1987 | Barkan | 200/148 B |
| 4,698,468 | 10/1987 | Pham | 200/148 G |
| 4,711,978 | 12/1987 | Jeanjean | 200/148 A |

*Primary Examiner*—Robert S. Macon

*Attorney, Agent, or Firm*—Nelson A. Blish; Eddie E. Scott; Alan R. Thiele

[57] ABSTRACT

An interrupter (10) having an outer housing (62) adapted to contain an arc-extinguishing fluid, a fixed tubular electrical current carrying member (40) disposed at one end; a movable tubular current carrying member (30) disposed in an end-to-end relationship with the fixed electrical current member (40); a prime mover for stroking the movable current carrying member (30) between an open position and a closed position; a piston means (16), carried by the movable electrical current carrying member, for supplying pressurized fluid between two current carrying members when the interrupter is opened; an insulated plenum means (22), carried by the piston means (16) and disposed around the contacting ends of the two current carrying members, for confining the flow of pressurized arc-extinguishing fluid into the gap formed between the two current carrying members when the interrupter is opened so as to direct ionized fluid and arc by-products away from the interior surfaces of the outer enclosure and to shield the operating components within the interrupter from direct blast of arc by-products released by the arc; arcing tips (32) and (42) carried on movable tubular current-carrying member (30) and fixed tubular electrical current-carrying member (40) respectfully; and, gas shield seal (36) comprised of C-Ring (37) and teflon sleeve (38).

17 Claims, 3 Drawing Sheets

RECLOSER PLENUM PUFFER INTERRUPTER

BACKGROUND OF THE INVENTION

This invention relates in general to circuit interrupters and more particularly to fluid-blast circuit interrupters of the puffer type.

Puffer interrupters have enjoyed commercial success due in part to their simple construction and excellent service record. The increased use of puffer interrupters in power class circuit breakers has been at the expense of the more complex two-pressure interrupters. Unfortunately, compared to a two-pressure interrupter, a puffer interrupter requires a relatively large prime mover.

The prime mover of a power class interrupter is a small part of the total cost of the interrupter relative to the cost of a prime mover in a distribution class or subtransmission class breaker or interrupter. Therefore, the cost of a large prime mover has less impact on the total cost of a power class circuit breaker than on the cost of a distribution class breaker. If one were to design a cost effective distribution class breaker or recloser using the puffer interrupter concept, the designer must minimize the energy consumed by the prime mover in operating the breaker.

The breaking process is characterized by an arc appearing for a limited period of time across the gap between the opening contacts of the breaker. This arc plasma column imposes severe environmental conditions on the components of the interrupter. For example, the arc plasma has a temperature exceeding 20,000° Kelvin; the turbulent supersonic flow of the quenching gas in a changing flow geometry ranges from a few hundred meters per second to several thousand meters per second; and, the voltage gradient placed upon the components in the vicinity of the arc is large, e.g. 10 KV/cm.

Immediately after the current passes zero, the critical stress is dependent upon the rate at which the recovery voltage rises. This rate is relatively high following a short-line fault, e.g. 2–7 KV/usec. Those points at which the arc roots are located after contact separation are particularly high stressed and in addition are contaminated with metallic vapor and ionized fluid. Typically, these arc by-products are deionized and removed by a concentrated gas blast in the vicinity of the arc. Because the gap region is open to the interior surface of the interrupter housing, part of the arc by-products are dissipated to the surrounding gas, while the majority is drawn through the tubes or hollow contact elements of the puffer.

Normally the nozzle surfaces across which the arc is formed "ablate" during the interruption process. As a nozzle ablates, its dimensions change and the arc geometry is effected. Ultimately, with the deterioration of the nozzle surfaces, the interruption rating of the device will be effected. Thus, the service life of a puffer interrupter will be increased by having components in the vicinity of the arc that effect the geometry or the flow of arc extinguishing fluid resistant to ablation by the arc.

In addition to the ablation problem, those skilled in the art have known that materials in the gap having a dielectric constant different from that of the gas or arc extinguishing fluid cause a distortion in the surrounding potential field. This distortion can cause high-voltage stresses to appear across the gap. These high-voltage stresses, in turn, can initiate a flashover of the contacts while they are separated or when the interrupter is opened.

If the materials having a different dielectric constant, i.e., so called "shunting dielectrics", are removed, a more uniform potential field is created in the vicinity of the gap. This in turn would reduce the voltage stress and decrease the possibility of a flashover. In this context "shunting dielectrics" include such materials as Teflon, polytetrafluoroethylene, which have a dielectric constant significantly different from that of the quenching gas typically, sulphurhexafluoride ($SF_6$).

Areas of low dielectric strength can also be reduced by increasing the circulation of gas within the interrupter. Increased gas circulation would prevent stagnant gas, the gas most recently involved in the interruption process, from remaining concentrated in any one particular area of the interrupter. Circulation would provide a "mixing action" which would insure that the arc extinguishing gas has a more uniform dielectric strength throughout the interior of the interrupter. The gas most recently involved in the interruption process has a lower overall dielectric strength. Therefore, it is important to insure that gas having a relatively low dielectric strength does not build up in regions such as that surrounding the open contact gap and any point where a significant voltage stress exists between the current carrying parts of the interrupter and the ground. Critical insulating surfaces are those insulating surfaces in close proximity to the arc blast. Thus, if these surfaces are shielded from the arc, the fall out of arc products is minimized and the surrounding insulating surfaces can withstand the high-intensity radiation from the arc without the danger of a restrike or flashover.

As the operating voltage and current at which a puffer interrupter recloser operates at is reduced, the size and manufacturing costs of the unit becomes more critical. While other inventors have recognized the problems associated with the interruption process, few have proposed an apparatus that efficiently and economically resolves the problem of voltage stress and gas circulation. Millianowicz, U.S. Pat. No. 3,946,183, employs puffer piston arcing contacts and current carrying contacts, all requiring a fairly large driver mechanism. Holmgren, et al, U.S. Pat. No. 4,489,226, discloses a puffer interrupter which employs a plenum rather than a nozzle for directing the flow of dielectric fluid which improves circulation, however, this puffer interrupter employs separate current carrying and arcing contacts which also requires a relatively large driver.

For the most part, each of these earlier designs is complicated, requires extensive mechanical linkages and connections, and is expensive to manufacture and maintain in operation once it is put in use. An inexpensive, relatively simple, innovative design for a small compact puffer interrupter of the subtransmission or distribution class variety would be a welcome addition to the art. This would be particularly true if the design incorporated features which would reduce maintenance and operating costs.

SUMMARY OF THE INVENTION

In accordance with the present invention, an interrupter is provided having: an outer housing or enclosure adapted to contain an arc-extinguishing fluid; a fixed electrical current carrying member; a movable current carrying member disposed in an end-to-end relationship with the fixed electrical current carrying member; a prime mover for stroking the moveable current carrying member between an open position and a closed position; a piston means, carried by the movable electrical current carrying member, for supplying pressurized fluid into the gap formed between the two current carrying members when the interrupter is opened; a non-electrically conductive lower terminal or base means carried by an interrupter support tube housing the piston means and guiding the movement or the stroking of the movable current carrying member; and an insulated plenum means, carried by the piston means and disposed around the contacting ends of the two current carrying members, for confining the flow of pressurized arc-extinguishing fluid into the gap formed between the two current carrying members when the interrupter is opened. Preferably, each current carrying member defines an internal passageway in fluid communication with the gap across which the arc is formed. This passageway directs ionized fluid away from the gap and minimizes the discharge of arc by-products away from the arc and towards the interior surfaces of the outer enclosure. The piston means and the base means together form a variable volume chamber or compression chamber whose interior is pressurized when the prime mover strokes the moveable contact member from its closed position to its open position. Preferably, the plenum means has an axial length at least equal to the length of the arc formed between the electrical current carrying members that form the gap. This arrangement shields the radially disposed, adjacent interior surfaces of the outer enclosure from the ionized fluid and arc by-products formed across the gap when the interrupter is opened.

The base means has one or more check valves disposed between the variable volume chamber and the interior of the outer housing. The pressure developed within the variable volume chamber by the stroking of the piston means with the prime mover forces the check valve shut; the pressure reduction within the variable volume chamber caused by the stroking of the piston means with the prime mover to the shut or closed position has the effect of opening the check valve and drawing arc-extinguishing as into the variable volume chamber, thereby replenishing the chamber in preparation for the opening the interrupter. The base means includes a current interchange means for electrically connecting the moving current carrying member to an external electrical circuit.

The plenum means is connected to the piston in such a manner that a plurality of passageways is defined between the variable volume chamber and the open end of the plenum means. The plenum means, as such, defines a tubular chamber, which is connected to the piston and disposed around the exterior of the fixed current carrying member when the interrupter is closed so as to defind a flow restrictive annular opening. Thus, when the interrupter is opened, the fluid is discharged from the variable volume chamber and along the exterior of the arc formed between the two current carrying members until the fixed current carrying member passes beyond the open end of the plenum.

From the foregoing description, it should be clear that since the arc is confined within the plenum means, the entire low pressure volume of arc-extinguishing fluid at the exterior of the plenum means, is not diluted with gas having a lower dielectric strength. By requiring the arc extinguishing gas discharged from the variable volume chamber to flow toward the interior of the current carrying members, the pressure between the outer enclosure and the exterior of the plenum means is kept relatively low. This improves the mass flow rate of gas through the current carrying members. In addition, since the interruption process is confined within the interior of the plenum, and since ablative nozzles are preferably not employed, arc by-products are not discharged so as to increase the back pressure thereby reducing the energy requirements of the prime mover. Since the arcing and current carrying contacts are both carried on the movable current carrying member, the energy requirements for the prime mover are further reduced. Moreover, since material is not ablated, critical parts do not wear out and the effective duty cycle or operating life of the interrupter is increased. Finally, since the plenum means acts as a shield, the surrounding insulating surfaces of the tank or the enclosure are not exposed to high-intensity radiation. This improves the safety of operating personnel from the dangers of an internal fault. It also improves the reliability of the interrupter.

A gas shield separates the variable volume pressure chamber from the interior of the moving contact. Flexible contact fingers inside the gas shield slide around the stationary contact. The gas seal is comprised of a spring steel C-ring and a teflon sleeve and provide a flexible seal between gas shield and flexible fingers.

Those skilled in the art will understand from the detailed description following that the interrupter described features an arrangement wherein the moving parts are kept to a minimum and relatively low pressure is required to achieve interruption. Since separate current carrying contacts are not required, the number of moving parts carried by the prime mover has been reduced. Moreover, the interrupter exhibits extended life by employing a non-ablative plenum. The interrupter is also designed to expose the downstream side of the gas flow to a lower pressure; this is achieved by effectively allowing the downstream volume to be fully utilized. Pumping action is used to recirculate the gas and to prevent refilling the puffer cylinder with gas that was recently used to achieve interruption. Finally, an insulating plenum is employed to contain the interruption process thereby preventing deterioration of adjacent insulated parts as a result of being exposed to the arc by-products once an arc is produced.

Numerous other advantages and features of the present invention will become readily apparent in the following detailed description of the invention and the embodiments described therein, from the claims, and from the accompanying drawings.

DETAILED DESCRIPTION OF THE INVENTION

Figure 1:
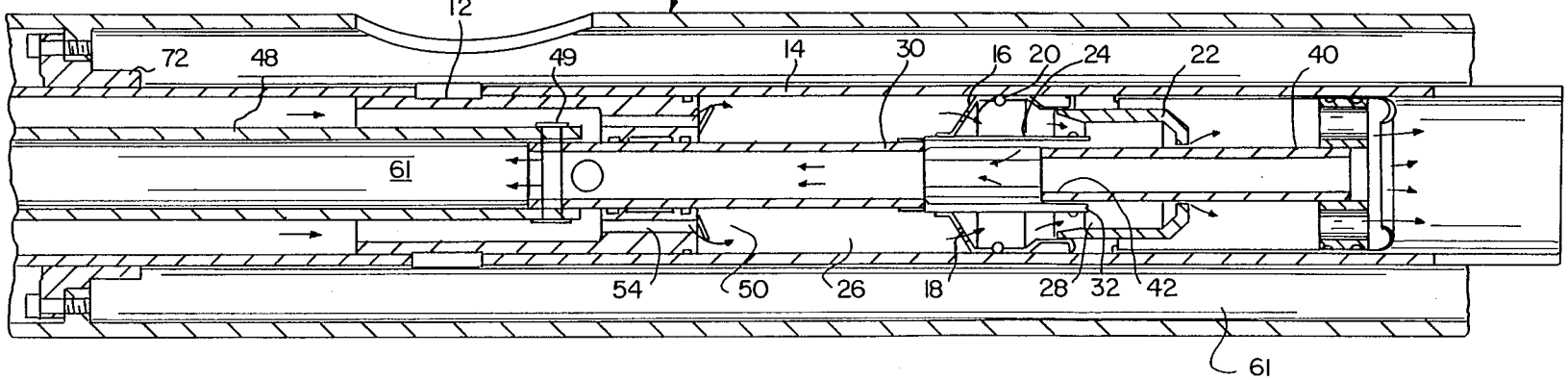
FIG. 1 is a cross-sectional view of a puffer interrupter according to the present invention in the closed or shut position.

While this invention is susceptible to embodiment in many different forms, there is shown in the drawings and will herein be described in detail one specific embodiment with the understanding that the present disclosure is to be considered as an exemplification of the principles of the invention and is not intended to limit the invention to the specific embodiment illustrated.

For ease of description, the interrupter that is the subject of this invention will be described in horizontal orientation as illustrated in the drawings, and the terms "right" or "left" will be used with reference to this position. It will be understood, however, that the apparatus of the invention may be manufactured, stored, transported, and sold in orientations other than that illustrated.

COMPONENTS

Referring to FIG. 1, the operating components of the puffer interrupter 10 are enclosed within an housing 62 which is adapted to contain therein an arc-extinguishing gas such as sulphurhexafluoride ($SF_6$). A metal housing 62 separates the internal components of puffer interrupter 10 from the outside atmosphere and provides a dielectric ground shield. Housing 62 is joined to interrupter support tube 14 by bolting ring or flange 72. In the preferred embodiment, housing 62 is aluminum.

Two current-carrying members 40 and 30 are disposed within interrupter support tube 14. Interrupter support tube may be comprised of a glass-filled epoxy tube with epoxy coating, a polyester-filled epoxy tube, a combination of these two with or without a teflon liner. These two current-carrying members are generally tubular in shape and are coaxially disposed relative to one another. Current-carrying member 40 is fixed in position while current-carrying member 30 is mounted so as to be movable toward and away from the current-carrying member.

The moving current-carrying member 30 is moved by means of a prime mover, not shown, connected to drive link 48. Drive link 48 is connected to lower current-carrying member 30 by drive pin 49. When the movable current-carrying member 30 is moved to the right, the fixed and movable current-carrying members come into contact in a coaxially manner such that a good electrical current path is formed.

Movable current-carrying member 30 is comprised of fingers 31, shown in more detail in FIGS. 3A, 3B, 4 and 5, with slots between the fingers. This arrangement provides lateral flexibility so that as moving contact 30 engages stationary contact 40, the fingers flex outward and slide up and around stationary contact 40, maintaining pressure on contact 40 so that a good electrical connection is made. Gas shield 24 surrounds the fingers 31 of moving contact 30 such that there is no flow of gaseous fluid between the interior of moving contact 30 and arc chamber 28 which surrounds moving contact 30. Gas shield 24 is a one-piece cylindrical shaped sleeve that fits outside of fingers 31. Shield 24 is attached to movable contact 30 by solder, welding or other means known in the art.

Figure 6:
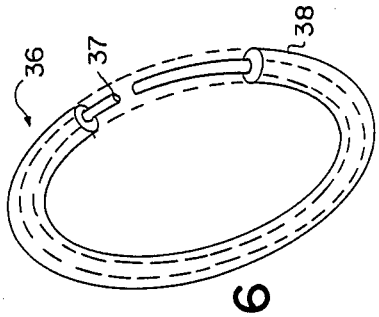
FIG. 6 is a perspective view of the gas shield seal with the teflon shield partially installed.
Figure 7:
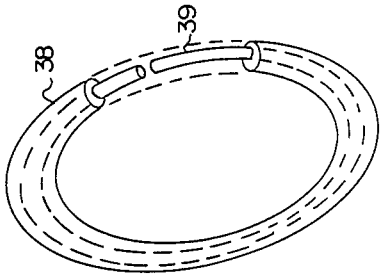
FIG. 7 is a perspective view of an alternate embodiment of a gas shield seal.
Figure 5:
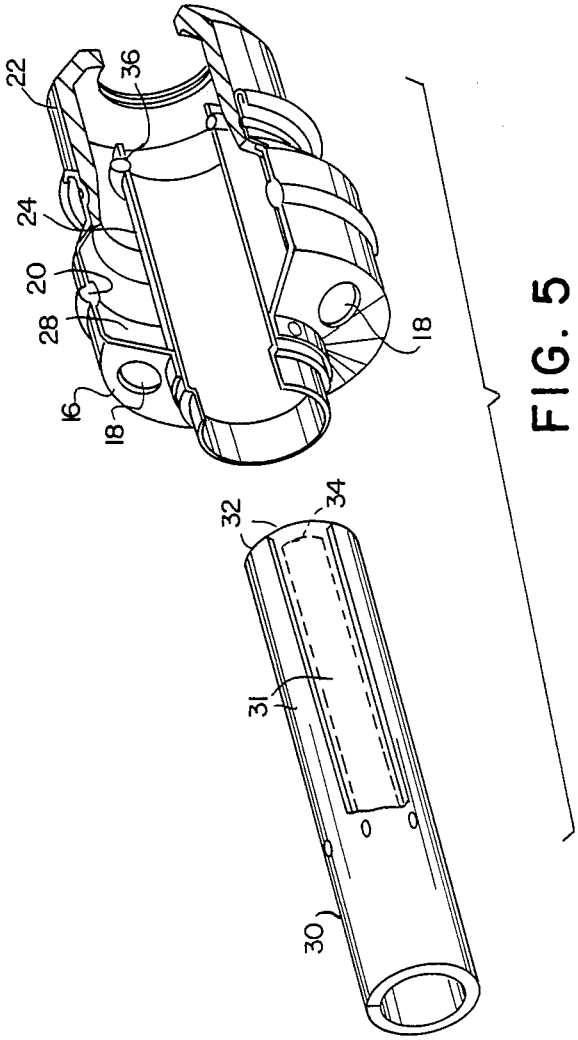
FIG. 5 is an exploded perspective view of the fingers and gas shield.

FIG. 6 shows detailed construction of seal 36. Seal 36 is comprised of a C-ring 37 with a teflon sleeve 38. Various seals were tried and it was found that O-rings made of rubber or similar materials deteriorated rapidly under arcing conditions. Seals made of metallic material were able to withstand the arcing conditions, however, conductors exposed to arcing conditions introduced vaporized metal particles into the arc which prolonged the arc and were thus unacceptable. A solution to this problem was enclosing a metal spring 37 inside an insulating sleeve such as teflon 38. Thus, the metal spring provided the flexibility and was able to withstand arcing conditions and yet the teflon sleeve provided insulation. FIG. 7 shows an alternate embodiment wherein a garter spring 39 is enclosed in a teflon sleeve 38.

Figure 4:
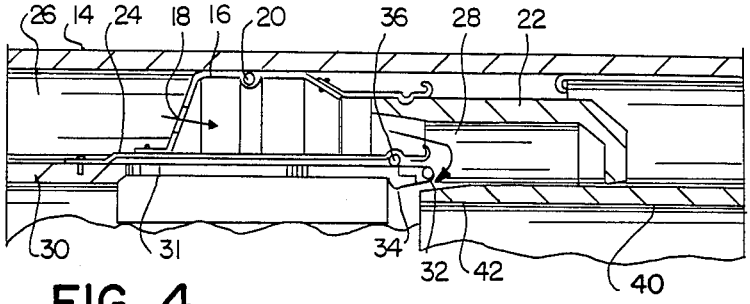
FIG. 4 is a cross sectional view of the plenum portion of the puffer interrupter just after the two current carrying members have separated.
Figure 3B:
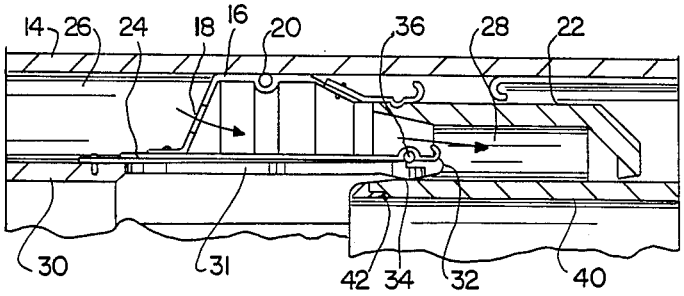
FIG. 3 is a cross sectional view of the plenum portion of the interrupter at the start of the opening cycle.

Referring now to FIGS. 3B and 4, piston 16 is attached to and moves with movable contact 30. A seal 20 maintains a pressure barrier between interrupt support 14 and piston 16. Gas ports 18 allow flow of fluid between compression or variable volume chamber 26 and arc chamber 28. Plenum 22 is attached to an moves with piston 16. Plenum 22 rides on stationary contact tube 40 in such a manner that flow of gas around plenum 22 is minimal.

Figure 3A:
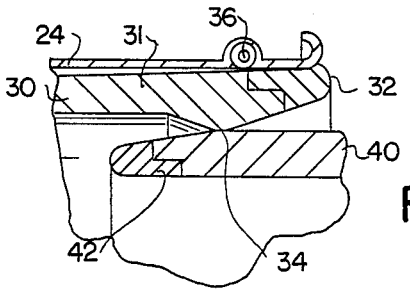

Stationery contact 40 and moving contact 30 both have arcing tips 42 and 34 as shown in FIGS. 3A and 3B. Arcing tips 42 and 34 are made of a copper tungsten material that does not readily erode or ablate during the arcing process. Immediately to the left of arcing tip 32 is current connection 34. Current connection 34 is a raised area on finger 31 and is designed to give good contact between fingers 31 and stationary contact 40. Fingers 31 are flexible and the diameter around the interior of current-carrying connections 34 is less than the outside diameter of stationary contact 40. Therefore, as movable contact 30 is moved to the right, fingers 31 are forced outward and held in contact by the spring action of fingers 31 with stationary tube 40.

OPERATION

Figure 2:
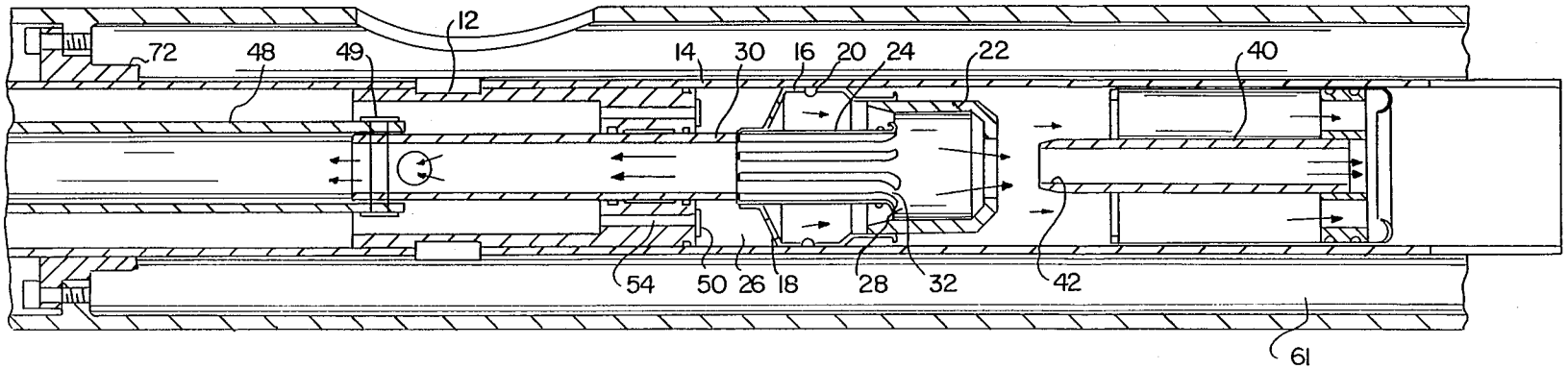
FIG. 2 is a view of the puffer interrupter shown in FIG. 1 in the fully opened position.

Referring to FIGS. 1 and 2, in order to interrupt the current flowing through interrupter 10, drive link 48 moves to the left, moving contact 30 to the left. As fingers 31 move left, piston 16 moves to the left also. Check valve 50 closes trapping $SF_6$ gas in compression chamber 26. Since there is no point for the gas to escape in view of the tight fit between stationary contact 40 and plenum 22 and a tight fit between current connection 34 and station contact 40, arcing or plenum chamber 28 is relatively gas tight (FIGS. 3A, 3B and 4). Gas port 18 provides an opening between arcing chamber 28 and compression chamber 26. The volume of arc chamber 28 stays relatively constant, however as piston 16 moves left, the volume of compression chamber 26 decreases, hence, the gas pressure increases.

Referring now to FIG. 4, as fingers 31 move left, arcing tip 32 and arcing tip 42 come in contact and begin to separate. As they separate, an arc is formed between the arcing tips which generates heat and further increases the pressure of the gas in the arcing chamber 28 and the compression chamber 26. As shown in FIG. 1 and 2, the arc also acts as a plug for preventing gas flow from the arcing chamber into housing chamber 61.

The current flowing between arcing tips 34 and 42 is alternating current and is sinusoidal in nature. As the current flows decrease to zero, the arc disappears and gas flows into housing chamber 61 and through stationary contact tube 40 and moving contact 30.

If the arc re-establishes itself on the next cycle, it again acts as a plug to stop the gas flow. The arc further heats the gas in the arcing chamber and further increases pressure of the gas. Thus, when the next zero point of current flow occurs, high pressure gas again flows from the compression chamber 26, into arcing or plenum chamber 28, to housing chamber 61 and then through gas stationary contact 40 and moving contact 30. All this time, fingers 31 are moving to the left and the distance between arcing contacts 32 and 42 is increasing. During arcing, the arc may fill up the whole plenum arcing chamber 28.

Gas, after flowing through stationary contact 40 and moving contact 40, equalizes inside the interior of housing chamber 61. After interruption of the arc, fingers 31 have been moved completely to the left and plenum 22 has completely disengaged from stationary contact 40. At this point, gas pressure has equalized throughout housing 62.

During the closing cycle, plenum 22 recontacts stationary contact 40 closing off the arcing chamber and compression chamber 26 from the housing chamber 61. At this point, check valve 50 on the lower terminal remains open allowing compression chamber 26 to maintain equalibrium with the interior of the housing chamber 61, otherwise, a vacuum would be drawn as piston 16 moves to the right. As arcing contacts 32 and 42 move closer together, at some point an arc forms which is, once again, contained within plenum 22. After arcing contacts are touching, current connection 34 slides up over stationary contact 40 and carries the current at contact poin 34.

I claim:

1. A distribution class interrupter, comprising:

an outer housing adapted to contain an arc extinguishing fluid therein;

an interrupter tube mounted within said housing;

a first elongated electrical current carrying member carried within said tube;

a second elongated current carrying member which is disposed end-to-end with said first member and which is movable within said tube between a closed position where it is in electrical contact with said first member and an opened position where it is spaced from said first member, said first member and said second member defining a gap when said second member is in its opened position such that an electrical arc is formed across said gap as said first member is separated from said second member, at least one of said first and second current-carrying members defining an internal passageway in fluid communication with said gap and the interior of said housing for directing ionized fluid thereformed, said second member being adapted to be operated by a prime mover to stroke said second member between its opened position and its closed position;

piston means, carried by said second member, for supplying pressurized fluid into said gap as said second member is moved into its opened position, said piston means moving between an open position and a closed position in response to said prime mover;

base means, carried by said interrupter tube for supporting said second elongated current-carrying member and said piston means, said base means and said piston means defining a variable volume chamber whose interior is pressurized when said prime mover strokes said second member from its closed position to its opened position;

insulated plenum means, carried by said piston means and disposed around the contacting ends of said first member and said second member, for confining the fluid supplied by said piston means from said variable volume chamber in the vicinity of said gap until said arc is extinguished, said plenum means having a length at least equal to the length of the arc formed between said first and second members, whereby the interior of said outer enclosure adjacent said gap is shielded from the ionized fluid thereformed;

an arcing tip carried on said first elongated current-carrying member;

a second arcing tip carried on said second elongated current-carrying member; and, wherein said first and second elongated current-carrying members carry both arcing current and steady state current.

2. A distribution class interrupter as in claim 1 wherein said second elongated current-carrying member is comprised of flexible fingers.

3. A distribution class interrupter as in claim 2 wherein said fingers terminate in arcing tips.

4. A distribution class interrupter as in claim 2 wherein said arcing tips are comprised of copper tungsten material.

5. A distribution class interrupter as in claim 2 wherein said fingers are surrounded by a gas shield.

6. A distribution class interrupter as in claim 5 wherein a seal is positioned between said gas shield and said fingers.

7. A distribution class interrupter as in claim 6 wherein said seal is comprised of a flexible metal ring and an insulating sleeve.

8. A distribution class interrupter as in claim 7 wherein said insulating sleeve is teflon.

9. A seal for use in environments subject to arcing conditions comprising:

a flexible ring; and an insulating sleeve surrounding said flexible ring.

10. A seal as in claim 9 wherein said insulating sleeve is teflon.

11. A seal as in claim 9 wherein said flexible ring is comprised of spring steel.

12. A seal as in claim 9 wherein said flexible ring is a garter spring.

13. A compact puffer interrupter, comprising:

an outer housing containing an arc extinguishing fluid;

an interrupter support tube mounted within said outer housing;

a stationary current carrying means disposed within said support tube;

an axially movable current carrying means disposed within said support tube and axially movable within said support tube between a closed position, where the movable current carrying means is in electrical contact with said stationary current carrying means, and an open position, where said movable current carrying means is axially displaced from said stationary current carrying means to define a gap therebetween, such that an electrical arc is formed across said gap;

piston means, on said movable current carrying means, for supplying fluid into said gap as said movable means is moved into its open position;

base means, on said support tube, for supporting said movable means, said base means and said piston means defining a variable volume chamber whose interior is pressurized when said movable means is axially displaced from a closed position to an open position; and insulated plenum means, on said piston means, for confining said fluid in the vicinity of said gap until said electrical arc is extinguished.

14. A compact puffer interrupter as in claim 13, further comprising;

a first arcing tip on said stationary current carrying means; and a second arcing tip carried on said movable current carrying means.

15. A compact puffer interrupter as in claim 13, wherein said stationary means and said movable means carry both arcing current and steady state current.

16. A compact puffer interrupter as in claim 13, wherein said movable means includes flexible fingers for electrically engaging said stationary means when said movable means is in the closed position.

17. A compact puffer interrupter as in claim 16, wherein said fingers terminate in arcing tips and said fingers are surrounded by a shield.

* * * * *

UNITED STATES PATENT AND TRADEMARK OFFICE

CERTIFICATE OF CORRECTION

PATENT NO. : 4,841,108
DATED : June 20, 1989
INVENTOR(S) : Sidney R. Hamm

It is certified that error appears in the above-identified patent and that said Letters Patent is hereby corrected as shown below:

Column 7, line 12 - delete "moving contact 40" and insert --moving contact 30--.

Column 7, line 30 - delete "poin" and insert --point--.

Signed and Sealed this

Twenty-ninth Day of December, 1992

*Attest:*

DOUGLAS B. COMER

*Attesting Officer*

*Acting Commissioner of Patents and Trademarks*